US005395265A

United States Patent [19]

DiMondi et al.

[11] Patent Number: 5,395,265

[45] Date of Patent: Mar. 7, 1995

[54] RETENTION SYSTEM FOR A CONNECTOR HOUSING

[75] Inventors: Vincent D. DiMondi, Raleigh, N.C.; John D. Walden, Mechanicsburg; Gerald N. Wilson, New Cumberland, both of Pa.

[73] Assignee: Berg Technology, Inc., Reno, Nev.

[21] Appl. No.: 204,488

[22] Filed: Mar. 2, 1994

Related U.S. Application Data

[63] Continuation of Ser. No. 29,979, Mar. 12, 1993, Pat. No. 5,318,464, which is a continuation of Ser. No. 895,508, Jun. 8, 1992, abandoned, which is a continuation-in-part of Ser. No. 730,984, Jul. 16, 1991, Pat. No. 5,120,256.

[51] Int. Cl.[6] ..... H01R 13/639

[52] U.S. Cl. ..... 439/553; 439/566

[58] Field of Search ..... 439/79, 83, 553, 566, 439/563, 569, 570

[56] References Cited

U.S. PATENT DOCUMENTS 4,629,278 12/1986 Norton et al. ..... 439/570
5,007,844 4/1991 Mason et al. ..... 439/83 X
5,096,440 3/1992 Katsumata ..... 439/570
5,186,659 2/1993 Enomoto et al. ..... 439/570
5,259,789 11/1993 Patel et al. ..... 439/570

FOREIGN PATENT DOCUMENTS 0210686 2/1987 European Pat. Off. ..... 439/563

*Primary Examiner*—Eugene F. Desmond
*Attorney, Agent, or Firm*—Woodcock Washburn Kurtz Mackiewicz & Norris

[57] ABSTRACT

A retention system for retaining a connector housing to a substrate includes a pair of slotted arms extending from the housing and a wedge-shaped abutment member having a camming surface and a latching surface thereon. One leg of an L-shaped clip is insertable into a channel defined by the slotted arms. The top edge of this leg of the clip is notched to form a tab. The clip is deflectable by the camming surface as the leg advances into the channel until the latch bar on the clip snaps into latching engagement with the latching surface on the abutment member, thereby to secure the clip to the housing.

The second leg of the clip is bent to underlie the connector housing when the clip is attached thereto.

27 Claims, 8 Drawing Sheets

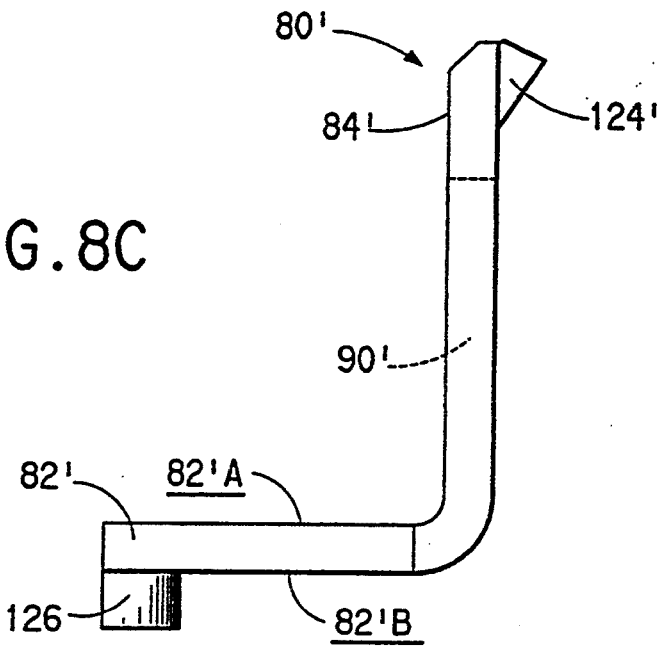
FIG.8C
FIG.8D
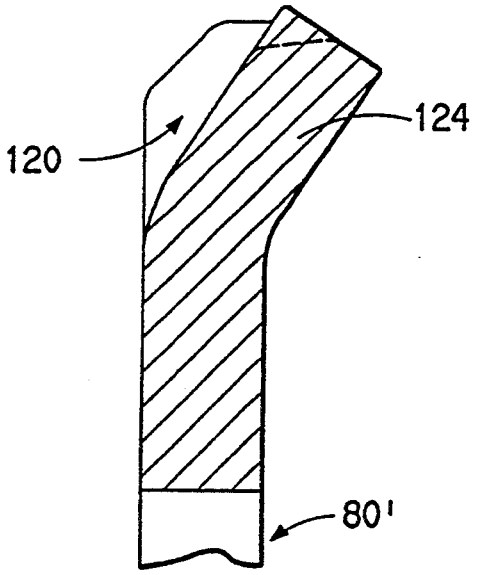

RETENTION SYSTEM FOR A CONNECTOR HOUSING

CROSS-REFERENCE TO RELATED APPLICATION

This is a continuation of application Ser. No. 029,979, filed Mar. 12, 1993, now U.S. Pat. No. 5,318,464, which was a continuation of Ser. No. 895,508, filed Jun. 8, 1992, abandoned, which application was a continuation-in-part of application Ser. No. 07,730,984, filed on Jul. 16, 1991, now U.S. Pat. No. 5,120,256, issued Jun. 9, 1992, and assigned to the assignee of the present invention.

BACKGROUND OF THE INVENTION

1. Field of the Invention

The present invention relates to a retention system for retaining a connector housing of a surface mounted connector to a substrate.

2. Description of the Prior Art

Surface mounted connectors are typically used for interconnecting conductive tracings disposed on one surface of a substrate, such as a circuit board, with corresponding tracings disposed on the surface of another substrate. When using a surface mounted connector some provision must be made for retaining the housing of each connector to the surface of its associated substrate.

One typical retaining expedient includes the provision of a retaining member on one or both ends of the connector housing. The member is extensible into a through-hole provided in the substrate. One example of this expedient is the use of retaining hardware, as a bolt attached to the connector housing, and a cooperating nut which threads to the bolt on the undersurface of the substrate to hold the housing in position.

In other examples of this form of retaining arrangement the retaining member is provided with a hook with a barb which engages the boundary of the through-hole in the substrate. This arrangement is used in the retaining arrangement disclosed in copending application Ser. No. 07/654,854, and copending application Ser. No. 07/654,869, both filed Feb. 13, 1991 and both assigned to the assignee of the present invention. Another example of a barbed retaining arrangement is disclosed in U.S. Pat. No. 4,907,987 (Douty. et al.).

In yet another form of such a retaining arrangement the retaining member has a resilient or a compliant feature which permits it to grasp the material forming the boundary of the through-hole. Such an arrangement is shown in U.S. Pat. No. 4,691,971 (Hahn), also assigned to the assignee of the present invention.

Other board retention devices are shown in U.S. Pat. No. 4,025,147 (Van Andale et al.), U.S. Pat. No. 4,616,893 (Feldman) and U.S. Pat. No. 5,004,430 (Del-Guidice et al.).

When using a surface mounted connector having such a retaining member care must be exercised during manufacture of the substrate that the through-holes therein are accurately positioned with respect to the conductive tracings on the surface of the substrate. To avoid problems attendant upon this registration requirement another retaining expedient utilizes a retainer that is securable, as by soldering, to mounting pads provided on the same surface as the conductive tracings. Since the mounting pads may be placed on the surface of the substrate at the same time as the conductive tracings, the pads may be located to tighter tolerances than the through-holes. An example of such a retaining arrangement is the board-to-board connector system manufactured and sold by Hirose Inc. as the HRS DF9 Series Board to Board Connector.

This last-mentioned retaining arrangement uses a rectanguloid abutment tab formed on at least one endwall of the connector housing. An L-shaped retaining clip having a cut-out formed in one leg thereof is inserted onto the abutment tab from the upper surface of the connector housing. The clip is held to the endwall by a pair of arms. The second leg of the clip is soldered or otherwise attached to the mounting pad, thereby to secure the housing on the surface of the substrate.

During manufacture of this last-mentioned retaining arrangement the retaining clip must be inserted onto the connector housing from the upper surface of the housing, that is, the surface that lies farther from the substrate when the connector is secured thereto. Although the electrical contact elements of this last-discussed retaining arrangement also happen to be inserted into the housing from the upper surface, there are instances where it is necessary or desirable to introduce the electrical contact elements into the housing from the lower surface of the housing, that is, from the surface that lies closer to surface of the substrate. For example, if the electrical contact elements are of the type having a curved transition portion that defines an open and a closed end the location of the carrier strip on such a contact would make insertion from the lower surface of the housing preferred. In such an instance, to have the retaining arrangement inserted from the upper surface of the housing, additional manipulative steps would have to be performed during the manufacture of the connector. This would be economically disadvantageous.

In view of the foregoing it is believed to be of advantage to provide a retention system for a surface mounted connector housing that is retained to mounting pads disposed on the same surface of the substrate as the conductive tracings. Moreover, it is also believed advantageous to provide a retention system in which both the retaining clip and the electrical contacts are introduced onto or into the housing from the housing surface that is proximal to substrate when the housing is secured thereto.

SUMMARY OF THE INVENTION

The present invention relates to a retention system for retaining a connector housing having a first and second endwall thereon to a substrate. The housing has a first major surface defining a first peripheral edge and a second major surface defining a second peripheral edge. The first major surface of the housing lies proximal to the substrate when the connector housing is retained thereto. The connector housing has a recess therein that extends between the first and second major surfaces. A plurality of electrical spring contact elements are received in the recess, the contact elements being insertable into the housing from the first major surface thereof.

The retention system comprises a pair of arms extending from at least the first endwall, the arms having slots therein that cooperate to define a channel. The channel has an inlet end that is adjacent to the first major surface of the endwall. The retention system also includes a wedge-shaped abutment member disposed on the first endwall intermediate the arms forming the pair of arms. The abutment member has a camming surface and a latching surface thereon. The camming surface has a first and a second end. The abutment member extends for a predetermined length dimension on the endwall between the first end of the camming surface and the latching surface.

The first end of the camming surface is presented to the first major surface of the housing. The first end of the camming surface may either join with the first peripheral edge of the housing or meld with the endwall a predetermined distance on the endwall from the first peripheral edge. The camming surface ramps outwardly from the endwall between the first and second ends thereof such that the second end of the camming surface is disposed a predetermined distance from the endwall.

The retention system further includes a retaining clip, preferably generally L-shaped. The clip has at least a base leg and a latching leg thereon. The clip has an opening, preferably formed in the latching leg of the clip, that defines a latch bar on the latching leg. The opening in the clip has a length dimension generally equal to the length dimension of the abutment member. The latching leg of the clip is insertable into the channel from the inlet end thereof such that the latch bar is deflectable by the camming surface as the latching leg of the clip advances into the channel. The latching leg of the clip is advanced into the channel until the latch bar snaps into latching engagement with the latching surface at the second end of the abutment member, thereby to secure the clip to the housing. The base leg of the clip is securable to a substrate, thus to retain the housing to the substrate. The clip may have shoulders provided thereon which abut against the arms when the clips is secured to the housing, In the most preferred instance the latch bar has a dimple formed therein. On a first connector the endwall on which the abutment member is disposed is spaced a predetermined distance away from a portion of the housing thereby to define a clearance space, the clearance space being sized to accommodate a second latch bar associated with a second retention system in accordance with the invention provided on the housing of a second connector. The latch bar of the second retention system also has a dimple therein. The second latch bar is extendable into the clearance space, thereby to place the dimples on the first and the second latch bars into mated engagement, thus holding the first and second connectors in mated engagement.

BRIEF DESCRIPTION OF THE DRAWINGS

The invention will be more fully understood from the following detailed description thereof taken in connection with the accompanying drawings, which form a part of this application and in which:

FIGS. 8A, 8B and 8C are, respectively, front elevational, plan and side views of a retaining clip forming a part of the retention system of the present invention, while FIG. 8D is an enlarged side elevational view taken in section along section lines 8D—8D in FIG. 8A.

DETAILED DESCRIPTION OF THE INVENTION

Figure 1:
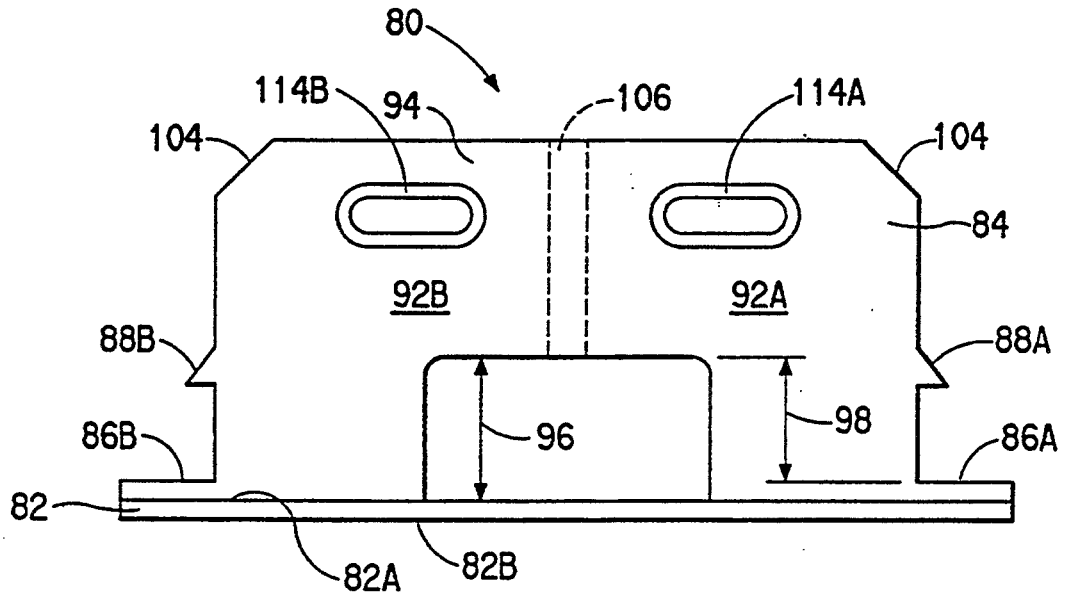
FIG. 1 is a front elevational view of a retaining clip forming a part of the retention system of the present invention.

Throughout the following detailed description similar reference numerals refer to similar elements in all Figures of the drawings.

With reference to FIGS. 1 to 4 shown is a retention system generally indicated by the reference character 10 (shown collectively in FIG. 4) for retaining a connector housing 12 to the surface 14 of a substrate 16, The substrate 16 may either take the form of any rigid mounting member, such as a printed circuit board, or a flexible mounting member.

The housing 12 is formed of an insulating material and has an overall configuration of a generally rectanguloid member. As is perhaps best seen in FIG. 3 the housing 12 includes a first, base, portion 18 and a second, contact casing, portion 20 formed integrally therewith. The exterior surface of the base portion 18 defines a first major exterior surface 22 of the housing 12. The first major exterior surface 22 terminates in a first peripheral edge 24. The first exterior surface 22 and the first peripheral edge 24 lie proximal to the substrate 16 when the connector housing 12 is retained thereto.

Figure 3:
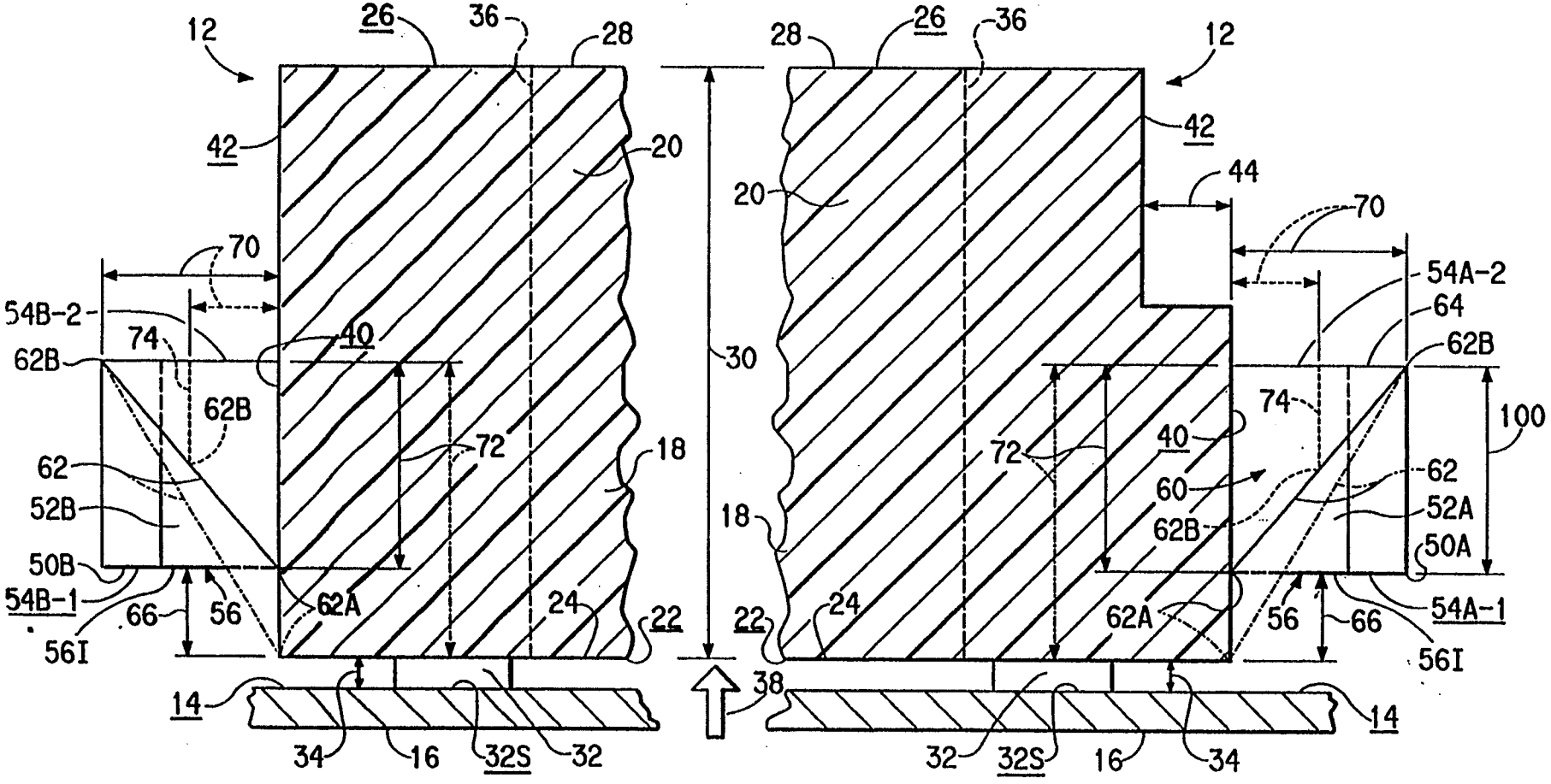
FIG. 3 is a side elevational view in section, taken along section lines 3—3 in FIG. 2, illustrating various locations at which the wedge-shaped abutment member may be disposed on the endwall of the connector housing.

The exterior surface of the contact casing portion 20 defines a second major exterior surface 26 of the housing 12. The second major exterior surface 26 has a second peripheral edge 28. The second major exterior surfate 26 is spaced from the first exterior surface 22 by the height dimension 30 of the housing 12, (FIG. 3). The first major exterior surface 22 may have standoffs 32 (FIG. 3) provided thereon, the standoffs 32 spacing the first surface 22 any convenient distance 34 from the substrate 16.

The housing 12 is provided with a central cavity, or recess, 36 that receives electrical spring contact elements (not shown). The recess 36 extends through the housing 12 from the first major surface 22 to the second major surface 26 thereof. During manufacture the electrical spring contact elements are introduced into the recess 36 of the housing 12 in the direction of the arrow 38 (FIG. 3), that is, from the first major surface 22 thereof. Preferably, the interior of the housing and the form and arrangement of the electrical spring contact elements therein is as disclosed and claimed in copending application Ser. No. 07/730,985, filed contemporaucously herewith and assigned to the assignee of the present invention.

The first, base, portion 18 of the housing 12 has first and second endwalls 40 thereon. Similarly, the contact casing portion 20 of the housing 12 also has first and second endwalls 42.

The housing 12 may be arranged as shown at either the fight-hand end or left-hand end of FIG. 3. In one instance, illustrated only in the right-hand portion of FIG. 3, the endwall 42 on the contact casing portion 26 is offset from the endwall 40 on the base portion 18 by a predetermined distance 44. As will be developed, the clearance space defined by the offset distance 44 finds utility in one preferred use of the present invention. In another instance, illustrated for convenience on the left-hand end of FIG. 3, the endwall 42 on the contact easing portion 26 is coplanar with the endwall 40 on the base portion 18. It is, of course, understood that in the preferred ease both lateral ends of a given connector housing 12 will exhibit the same endwall configuration, i.e., one in which the endwalls 40, 42 on both lateral ends of the housing are either offset or coplanar with each other.

Figure 2:
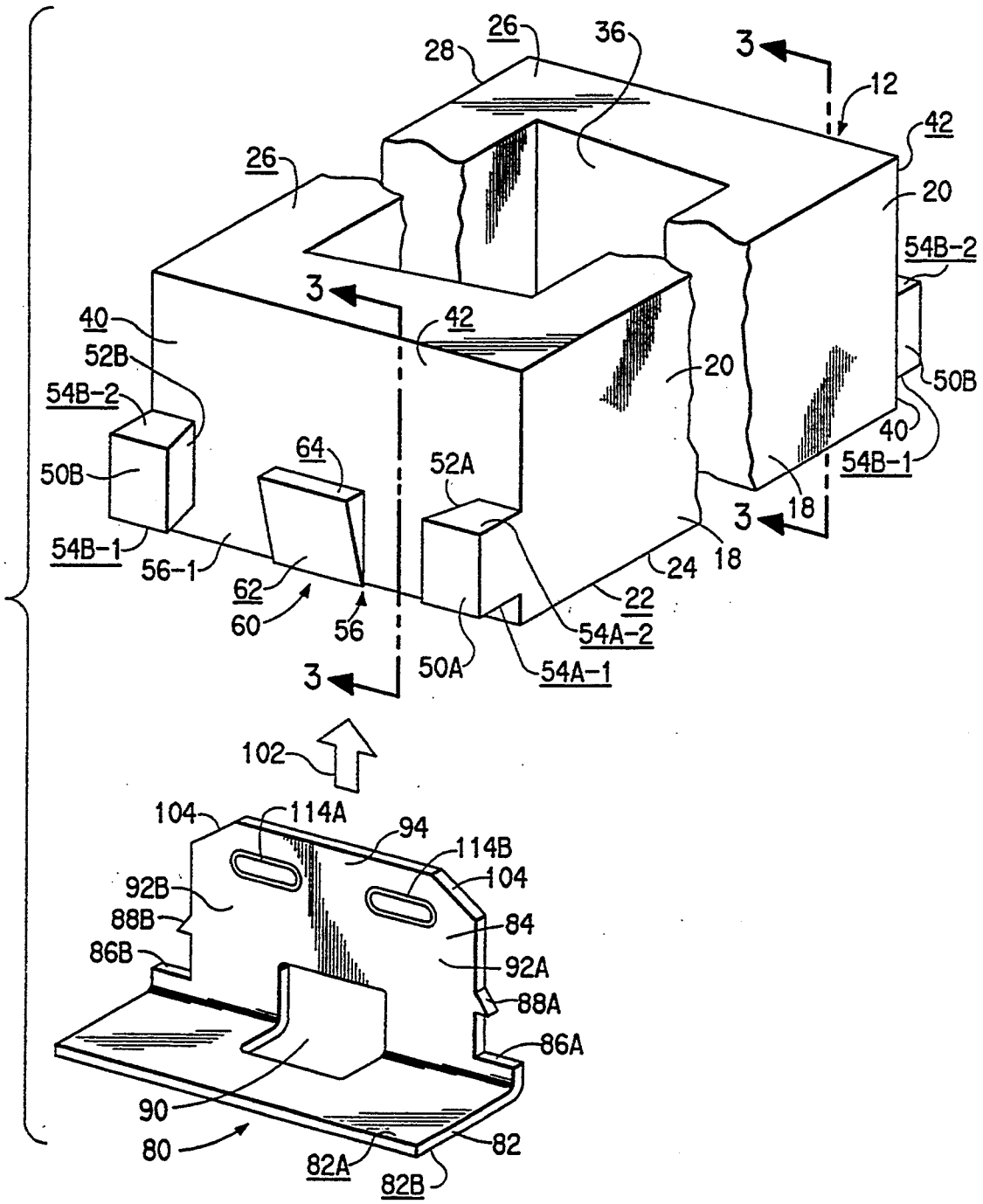
FIG. 2 is a perspective view of the retaining clip, as shown in FIG. 1, and of a wedge-shaped abutment member that also forms part of the retention system of the present invention, the abutment member being formed on an endwall of a connector housing, with the retaining clip about to be inserted onto the abutment member on the housing.

In accordance with this invention the retention system 10 includes at least a first-pair of arms 50A, 50B extending from at least one endwall 40 of the base portion 18. Preferably the arms are provided on each endwall 40 of the base portion 18. Each of the arms 50A, 50B has a respective slot 52A, 52B therein. The arm 50A has a first and a second surface 54A-1, 54A-2, respectively, thereon while the arm 50A has a first and a second surface 54B-1, 54B-2, respectively. The slots 52A, 52B cooperate with the endwall 40 to define a channel 56 (FIGS. 2 and 3). In the preferred case the slots 52A, 52B are inclined with respect to the endwall 40, thereby to define a dovetail shaped channel. The channel 56 has an inlet end 56I that is, in the preferred case, disposed adjacent to the first major surface 22 of the housing 12. Thus, the inlet end 56I of the channel 56 is presented toward to the same major surface 22 of the housing 12 from which the contact spring elements are inserted into the recess 36 and the major surface 22 that lies adjacent to the surface 14 of a substrate 16 when the connector housing 12 is mounted on and retained thereto.

The retention system 10 also includes a wedge-shaped abutment member 60 disposed on the first endwall 40 intermediate the arms 50A, 50B thereon. The abutment member 60 has a camming surface 62 and a latching surface 64 thereon. The latching surface 64 is preferably coplanar with the second surfaces 54A-2, 54B-2 on the arms 50A, 50B, respectively, although it may be arranged to lie above or below the same.

The camming surface 62 has a first end 62A and a second end 62B thereon. The camming surface is arranged on the endwall with the first end 62A presented toward the first major surface 22 of the housing 12. In one configuration the first end 62A of the Camming surface 62 lies a predetermined distance 66 from the first edge 24 of the surface 22, as is illustrated in FIG. 3 in solid lines. Any convenient distance may be selected for the distance 66, thereby disposing the first end 62A of the camming surface at any convenient location along the endwall 40. Preferably, the end 62A aligns with the first surface 54A-1, 54B-1 on the arms 50A, 50B, respectively. In an alternative configuration the first end 62A of the camming surface 62 joins to the edge 24 of the first major surface 22 of the housing 12. This arrangement is shown in FIG. 3 by the dot-dashed lines.

The first end 62A of the camming surface 62 preferably melds smoothly into the surface of the endwall 40 at its point of joinder thereto and should meet the endwall 40 with only slight surface discontinuity. Alternatively, it lies within the contemplation of the invention to space the first end of the surface 62 a predetermined distance, or step, outwardly from the endwall 40. However, as will be developed, the step should not be so large as to interfere with the passage of a retaining clip 80 (to be described) through the channel 56.

However of wherever the first end 62A of the surface 62 is located with respect to the endwall 40, the second end 62B of the camming surface 62 is disposed a predetermined distance 70 from the endwall 40. The distance 70 is greater that any step (if provided), which is to say that the camming surface 62 ramps outwardly from the endwall 40 as one proceeds in a direction on the endwall 40 from the first end 62A toward the second end 62B. Preferably, the second end 62B of the camming surface 62 should not extend laterally from the endwall 40 past the outer extent of the arms 50A, 50B.

The abutment member 60 has a predetermined length dimension 72 measured on the endwall 40 between the first end 62A of the camming surface 62 and the latching surface 64. If desired, the abutment member 60 may be flattened, as indicated in the dotted lines at 74, adjacent to the latching surface 64 thereon. In such a ease, however, the length of the abutment is still defined as the dimension 72 along the endwall 40 between the first end 62A of the camming surface 62 and the latching surface 64.

The retention system 10 further includes a resilient retaining clip 80, best shown in FIGS. 1 and 2. Preferably, the retaining clip 80 is fabricated from an integral piece of any solderable stock, such as a copper alloy material. The clip 80 is securable to the housing 12 and forms the link whereby the same is retained to the surface 14 of the substrate 16. The retaining clip 80 is preferably L-shaped, having at least a base leg 82 and a latching leg 84 thereon. The base leg 82 has a first and a second surface 82A, 82B, respectively thereon. In the preferred case the width dimension of the latching leg 84 is less than the width dimension of the base leg 82, thereby to define a pair of shoulders 86A, 86B generally adjacent to the line of bending defining the L-shape of the clip 80. The latching leg 84 is shown in FIG. 1 to have barbs 88A, 88B thereon. The barbs 88A, 88B may be omitted if desired.

The clip 80 has an opening 90 formed therein. The opening 90 extends through at least the material of the latching leg 84 and, may, as illustrated, also extend through the material of the base leg 82. The opening 90 serves to define on the latching leg 84 a pair of uprights 92A, 92B and a latchbar portion 94. At least that part of the opening 90 that extends through the latching leg 84 has a length dimension 96, measured from the surface 82A of the base leg 82 to the latch bar 94 (FIG. 1) that is at least equal to the length dimension 72 (FIG. 3) of the abutment member 60. Moreover, the configuration of the opening 90 corresponds to the configuration of the abutment member 60. The exterior surface of the shoulders 86A, 86B are arranged to lie a predetermined distance 98 (FIG. 1) from the edge of the latch bar 94, for a purpose to be discussed. The distance 98 is equal to the distance 100 (FIG. 3) defined between the inlet end 561 of the channel 56 and the latching surface 64.

In use, to attach the clip 90 to the connector housing 12 the clip 90 is moved relatively to the housing 12 such that the latching leg 84 of the clip 80 is introduced into the inlet end 561 of the channel 56 in the direction of the arrow 102 (FIG. 2). The latch bar portion 94 on the latching leg 84 fides along the camming surface 62 and is deflected thereby as the leg 84 is advanced into the channel 56. When the latch bar 94 clears the camming surface 62 the latch bar 94 snaps into latching engagement with the latching surface 64 at the second end 62B of the abutment member 60, thereby securing the clip 80 to the housing 12. Judicious selection of the dimension 98 (FIG. 1) with respect to the distance 100 (FIG. 3), as set out earlier, insuresthat the shoulders 86A, 86B abut against the surfaces 54A-1, 54B-1, respectively provided on the arms 50A, 50B when the clip 80 is secured to the housing 12.

The width of the leg 84 of the clip should be selected to facilitate the insertion of the leg 84 into the channel 56 and to permit the advancement of the clip 80 thereinto. To this end, it maybe desirable to bevel the edges of the leg 84, as at 104, or to separate the latch bar 94 intotwo lobes by providing a slot 106 (FIG. 1) therein. When the clip 80 is secured to the housing 12 the surface 82A of the base leg 82 of the clip 80 is arranged so as to be coplanar with the first major surface 22 of the housing 12 (or with the exterior surfaces 32S, FIG. 3, of the standoffs 32, if provided).

It is noted that the clip 80 of the retention system 10 is secured to the housing 12 from the same direction 102 (FIG. 2) as the direction 38 (FIG. 3) of insertion of the electrical contact springs into the recess 36 of the housing 12. As a result economies of manufacturability are believed achieved using the retention system 10 of the present invention over retention systems that must be inserted onto the housing from a direction different from the direction in which the electrical spring contact elements are introduced into the housing 12.

Figure 4:
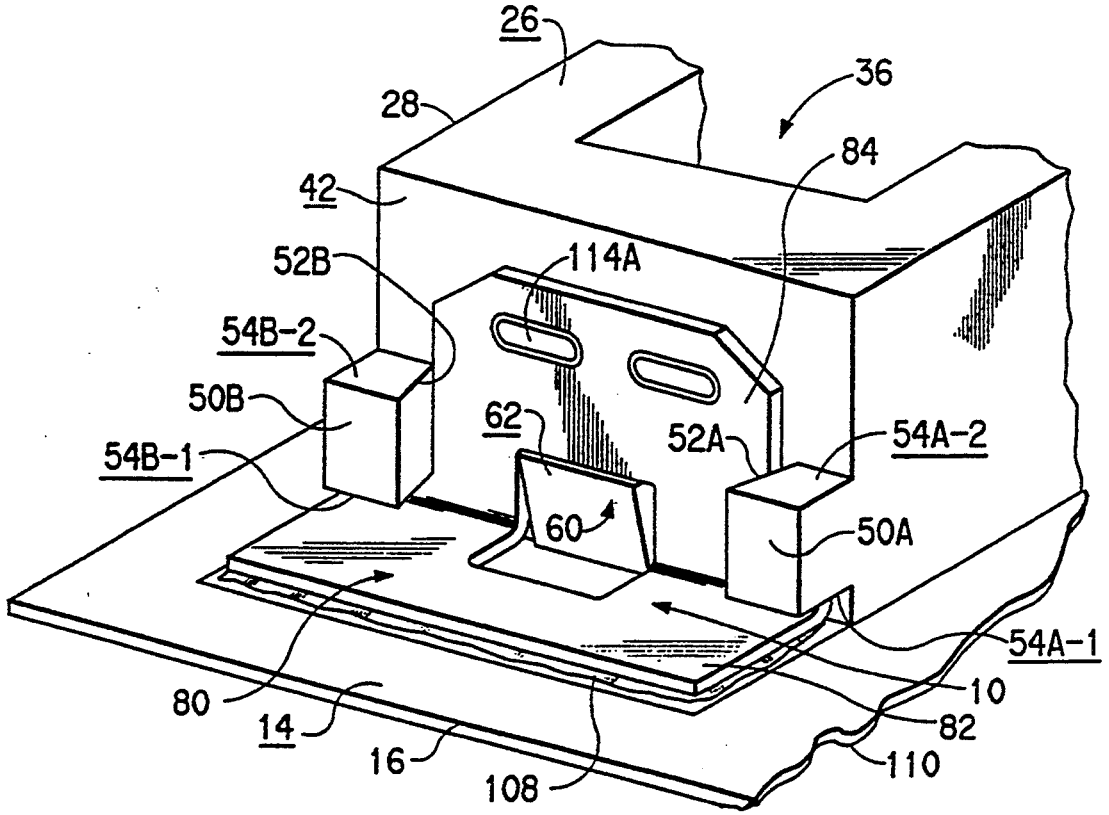
FIG. 4 is a perspective view of the retention system in accordance with the present invention when in use to retain a connector housing to the surface of a substrate.

The base leg 82 of the clip 80 may be secured to the substrate 16 by suitable means, such as the solder bead 108, to a mounting pad 110 on the surface 14 (FIG. 4). If the clip 80 is previously secured to the substrate 16, the housing 12 may be mounted to the clip 80 in a manner similar to that discussed heretofore, thereby to retain the housing 12 to the substrate 16. Alternatively, the clip 80 and the housing to which it is secured may be attached as unit to the surface 14 of the substrate 16 and thus retained thereto.

Figure 5:
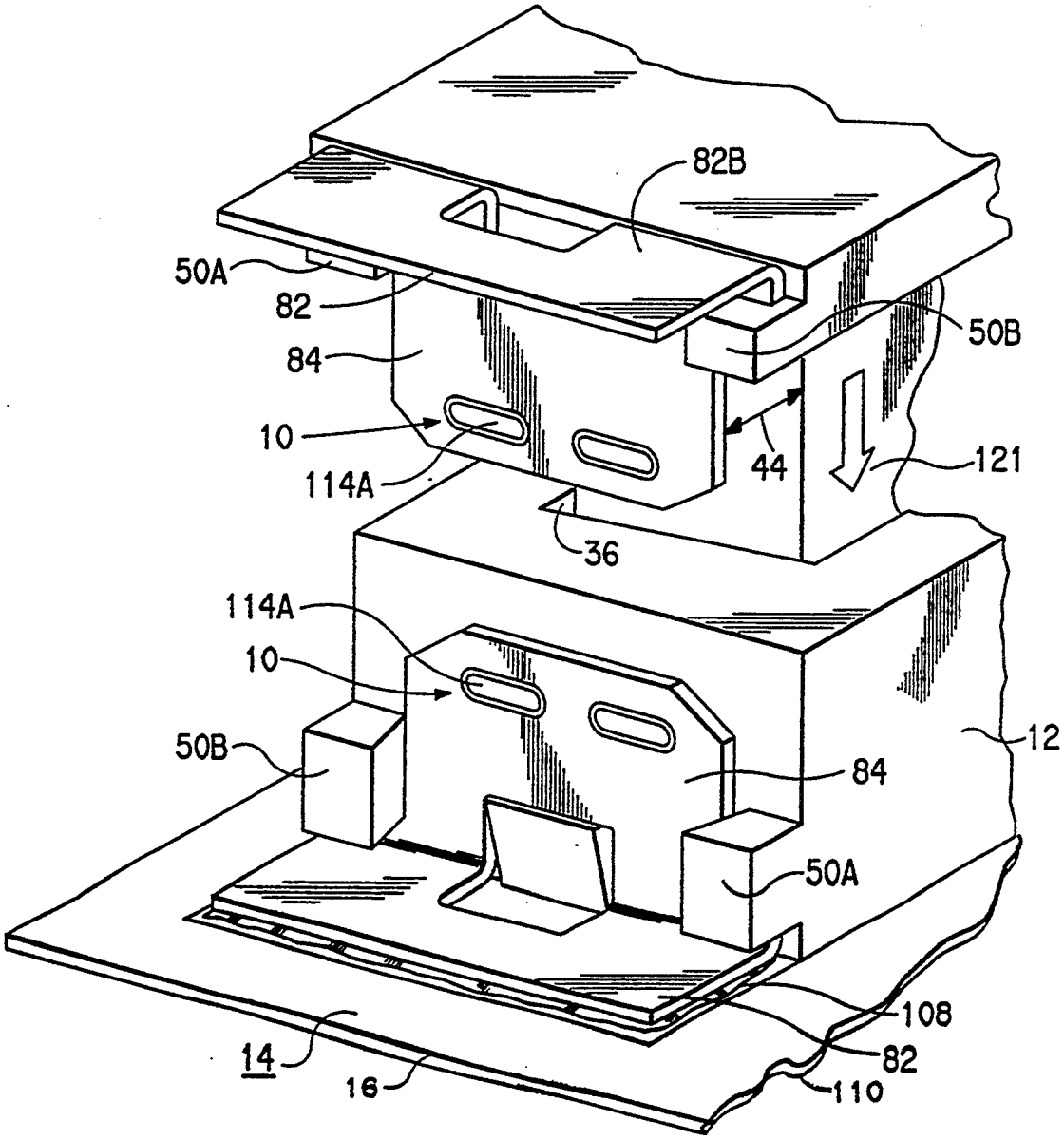
FIG. 5 is a perspective view illustrating the retention system in accordance with the present invention as disposed on a second connector housing as the same is about to be engaged with the retention system provided on the first connector housing.
Figure 6:
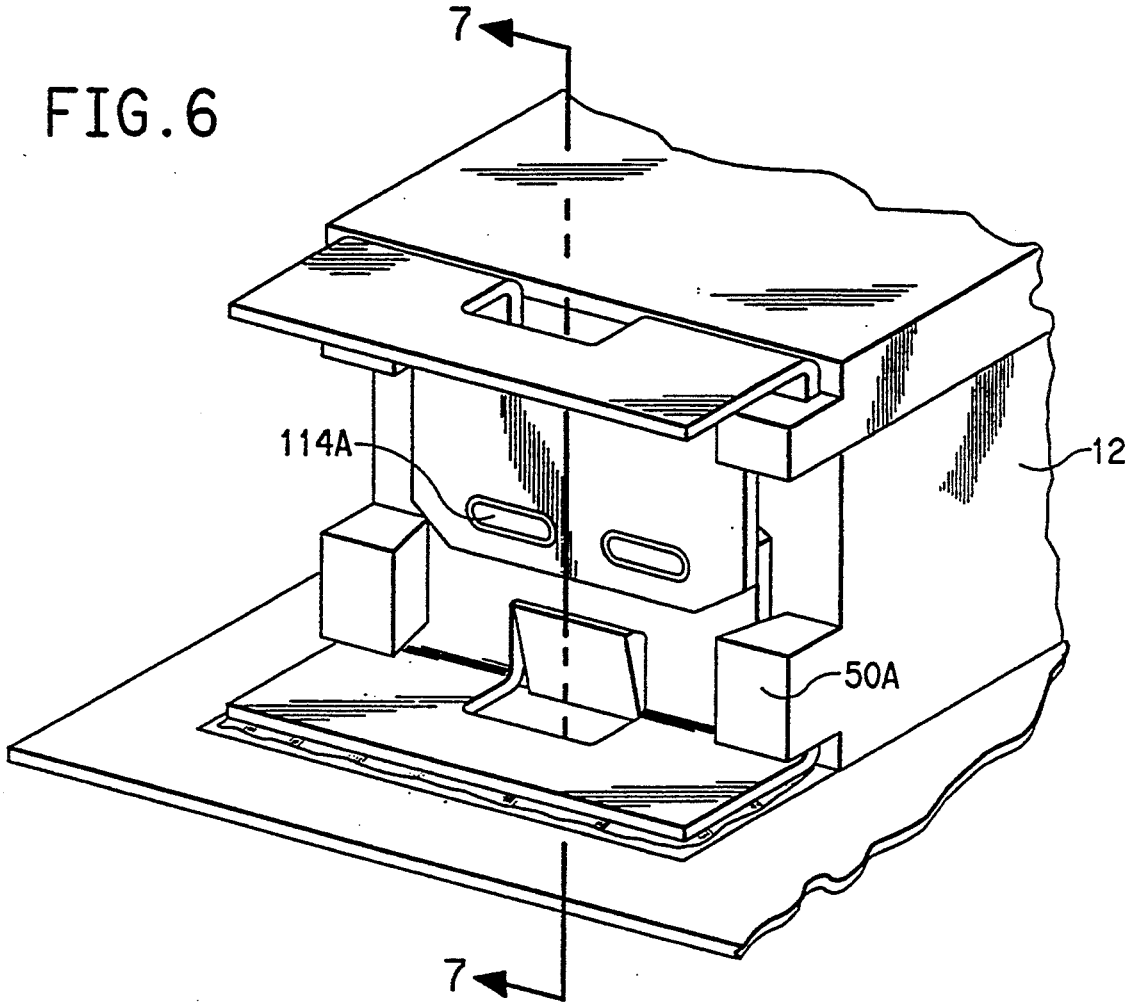
FIG. 6 is a perspective view illustrating the retention systems on the first and second connector housings when fully matedly engaged.
Figure 7:
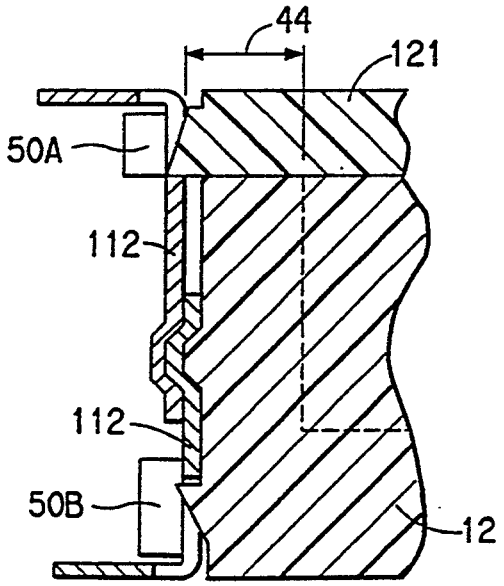
FIG. 7 is a sectional view taken along section lines 7—7 in FIG. 6 illustrating the retention systems on the first and second connector housings when fully matedly engaged.

As is illustrated in FIGS. 5 through 7, it lies within the contemplation of the present invention to utilize the retaining clip 80 to additionally attach one connector housing 12 to a second housing 12' having a retention system 10 in accordance with this invention. To this end, in the preferred embodiment, the latch bar portion 94 of the clip 80 has at least one dimple 114 formed therein. More preferable, however, is to provide a pair of dimples 114A, 114B on the latch bar 94. This arrangement of two dimples is shown in the Figures and is believed to enhance the flexibility of the latch bar 94, allowing it to deflect over the abutment member 60. Moreover, if the latch bar 94 is lobed, each lobe may have dimple therein.

A retention system 10 is attached to at least one endwall 40 on each of the housings 12, 12'. However, one of the housings 12' must be arranged with the endwall 42 of the contact casing portion 20 offset by the clearance distance 44 from the endwall 40 of the base portion 18. The latch bar portion 94 of the retention system 10 on the housing 12 will then be insertable into the clearance space so defined on the housing 12', thus to permit the dimples 114 on the latch bars 94 to engage, as is illustrated in FIGS. 6 and 7. Such an arrangement permits the retaining clip 80 of the retention system 10 on the housing 12 to serve a dual purpose, viz., to retain the housing 12 with which it is associated to the surface 14 of a substrate 16 and to attach one housing 12 to an associated second housing 12'. Assuming suitable electrical interconnection is made, the mated dimples 114 and associated retaining clips 80 may be used to provide a ground path from one board to another.

When the retention system 10 is mounted to the housing 12 to secure the same to the substrate the overall length dimension occupied by the retention system 10 and the housing 12 (as measured between the forward edges of the base legs 82 of the clips 80) may be deemed excessive for a given application. In this event it may be desirable to utilize resilient retaining clip(s) 80' of the form shown in FIGS. 8A through 8D and 9. In these Figures structural features generally analogous to features of the earlier disclosed embodiment of retaining clip are indicated by primed reference characters.

The retaining clip 80' is again a generally L-shaped member having a base leg 82' and a latching leg 84'. The base leg 82' has surfaces 82'A, 82'B thereon. An opening 90' is defined in the material of the base leg 82' and the latching leg 84'. As before, the opening 90' defines uprights 92'A, 92'B and a latch bar 94' in the latching leg 84'. The configuration and dimension of the opening 90' corresponds to the abutment member.60 on the housing 12, as discussed above.

Figure 9:
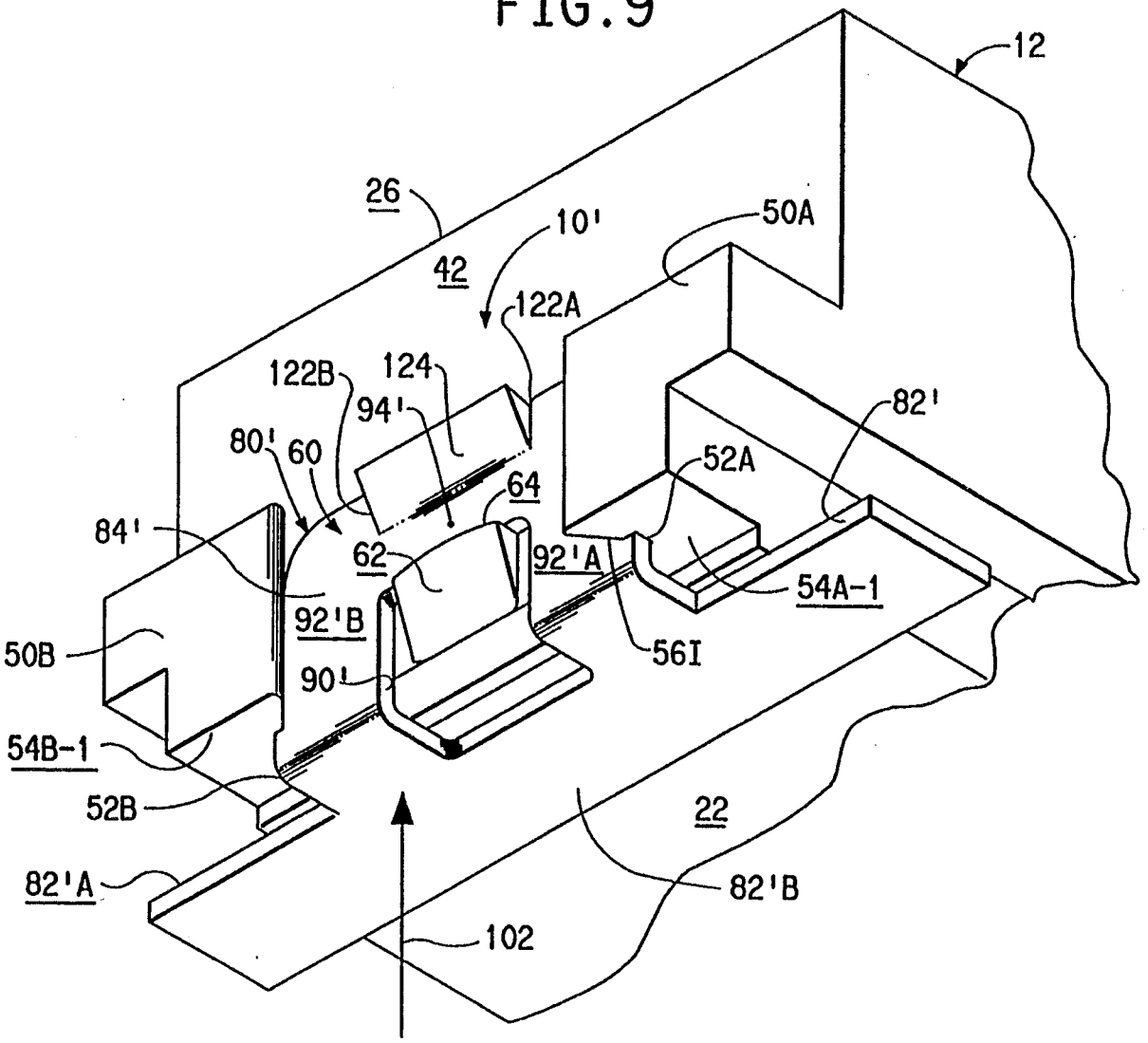
FIG. 9 is a perspective view of the retaining clip as shown in FIGS. 8A through 8D inserted onto the abutment member on the housing, the view being taken looking upwardly from the bottom surface of the connector housing.

In order to provide a retention system 10' that occupies a shorter overall length dimension, in its modified embodiment the retaining clip 80' the base leg 82' is bent along the line of bending with the latching leg 84' in such a fashion that the base leg 82' underlies theconnector housing 12 when the clip 80' is secured thereto (FIG. 9). Thus, the retaining clip 80' remains within the footprint of the connector housing 12 and does not contribute any additional length therebeyond. In this embodiment of the clip 80' the shoulders 86A, 86B are eliminated and the distance 98' is measured from the surface 82'A of the base leg 82'.

Figure 8B:
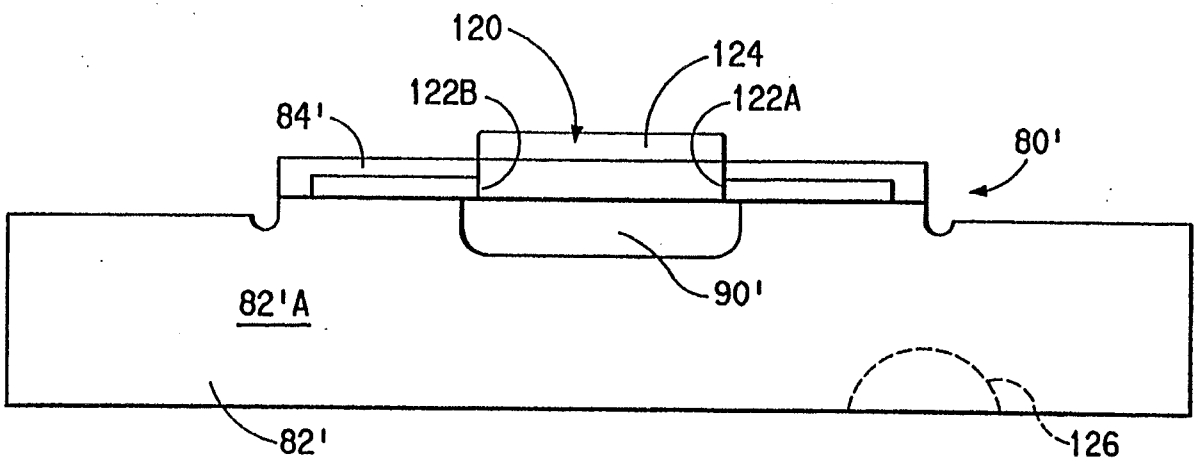
Figure 8A:
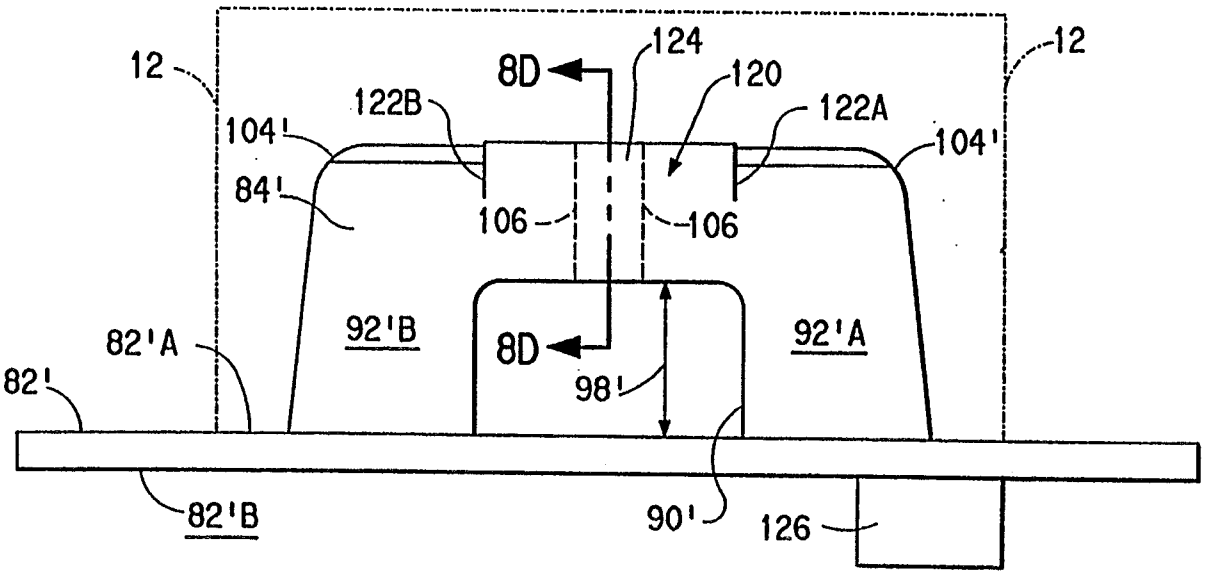

As is apparent from the FIGS. 8A through 9 the clip 80' is also modified from that earlier shown to exhibit an opening 120 disposed substantially centrally along the latch bar portion 94' of the latching leg 84'. In the preferred instance the opening 120 is formed by lance cuts 122A, 122B that extend into the latch bar 94' from the upper edge thereof. The lance cuts 122A, 122B define a tab 124 that bends outwardly away from the connector housing 12. The opening 120 may be provided in any alternate convenient manner, as by totally removing the material of the tab 124 from the latch bar 94'.

A key 126 (FIGS. 8A, 8B) may be provided on the base leg 82' to eliminate the possibility of erroneous disposition of the clip 80' on the substrate.

As in the previous embodiment, to facilitate entry of the clip 80' onto the housing 12, the edges of the leg 84' may be beveled as at 104' or a slot 106' (similar to the slot 106 shown in FIG. 1) may be formed in the latch bar 94'. Alternately, the lateral edges of the latching leg 84, 84' may be slightly inclined with respect to each other as one proceeds from the base leg toward the upper edge of the latch bar, thereby imparting a slightly trapezoidal configuration to the leg 84, 84'.

The retaining clip 80' is mounted to the connector housing 12 in a manner generally similar to that earlier discussed. The clip 80' is moved relative to the housing 12 such that the latching leg 84' enters into the inlet end 56I of the channel 56 in the direction of the arrow 102. The presence of the opening 120 (as defined by the bent tab 122) permits the lateral regions of the uprights 92'A, 92'B on the latching leg 84' to enter into the slots 52A, 52B in the respective arms 50A, 50B before the latch bar portion 94' on the latching leg 84' contacts the camming surface 62. The size of the opening 120 is selected such that the uprights 92'A, 92'B are well into the slots 52A, 52B before the latch bar 94' begins to ride along and to be deflected by the camming surface 62. Once the latch bar 94' clears the camming surface 62 the latch bar 94' snaps into latching engagement with the latching surface 64 at the second end 62B of the abutment member 60, thereby securing the clip 80 to the housing 12. The dimension 98' is judiciously selected with respect to the distance 100 (FIG. 3), as discussed earlier. In this embodiment, however, since the base leg 82' is bent to underlie the housing 12, it is the surface 22 of the housing 12 that contacts the surface 82'A of the base leg 82' when the clip 80' is secured to the housing 12. Since the base leg 82' is bent under the housing 12 the possibility of damage to the clip80' during handling is minimized.

The surface 82'B of the base leg 82' of the clip 80' may be secured to the substrate 16 by suitable means, as discussed earlier. As seen in FIG. 8A it should also be noted that the transverse dimension of the base leg 82' is substantially greater than the width dimension of the connector housing 12. This-provides increased surface area for securing the clip 80' to the substrate and for coupling soldering energy into the clip 80'.

Those skilled in the art, having the teachings of the present invention as hereinabove set forth, may effect numerous modifications thereto. It should be understood that these and such modifications lie within the contemplation of the present invention, as defined by the appended claims.

What is claimed is:

1. A retention clip for connecting a connector housing to a substrate, comprising:

a latching leg having a first and second edge and a first opening which cooperate with said connector housing to latch said retention clip to said connector housing; and a base leg extending from said latching leg for connecting said retention clip to said substrate, said base leg being bent to underlie said connector housing.

2. The retention clip of claim 1, wherein said latching leg has an upper edge and wherein a second opening is formed in said upper edge.

3. The retention clip of claim 2, wherein said second opening is formed by a tab extending outward from said latching leg.

4. The retention clip of claim 1, further comprising:

a key means extending from said base leg for mating with a mating key means provided on said substrate.

5. The retention clip of claim 1, wherein said latching leg has an upper edge and wherein said upper edge has beveled corners.

6. The retention clip of claim 1, wherein an abutment of said connector housing can be received within said first opening.

7. A retention system for connecting a connector to a substrate, comprising:

a connector housing having an endwall, said endwall having a channel and an abutment formed therein to provide a latching surface of said connector housing; and a retention clip having a first leg and a second leg, said first leg being capable of latching to said latching surface and said second leg being capable of connecting to said substrate while remaining within a footprint of said connector housing.

8. The retention system of claim 7, wherein said endwall comprises two arms extending outward from opposite sides of said endwall, said channel being defined by an area of said endwall between said arms.

9. The retention system of claim 7, wherein said abutment forms a camming surface.

10. The retention system of claim 9, wherein said first leg of said retention clip has an opening provided therein, said first leg being slideably insertable into said channel so that said first leg is deflected against said camming surface until said opening is slideably positioned over said entire camming surface to latch said first leg to said latching surface of said connector housing.

11. The retention system of claim 10, wherein said first and second legs of said retention clip are connected together to substantially form an L-shape.

12. The retention system of claim 11, wherein said retention clip is capable of latching to said latching surface so that said second leg underlies said connector housing.

13. The retention system of claim 9, wherein said connector is capable of mating with a mating connector, said mating connector having a mating latching surface and a mating retention clip latched thereto, said mating clip having a first and a second leg, and wherein at least one dimple is formed on said first leg of said retention clip for engaging at least one corresponding dimple formed on said first leg of said mating retention clip.

14. The retention system of claim 9, wherein said first leg has an upper edge, said retention clip comprising:

a tab formed in said upper edge to provide an opening to permit said retention clip to be slideably inserted along said channel and over said camming surface.

15. The retention system of claim 9, wherein said first leg has a slot formed therein for facilitating latching said retention clip to said latching surface.

16. The retention system of claim 7, wherein said first and second legs of said retention clip are connected together to substantially form an L-shape.

17. The retention system of claim 7, wherein said retention clip is capable of latching to said latching surface so that said second leg underlies said connector housing.

18. The retention system of claim 7, wherein said connector housing has a first major surface and a second major surface with a recess extending therebetween, said retention clip being capable of connecting said substrate to said connector so that a surface of said substrate is disposed adjacent to said second major surface, and wherein said connector comprises a plurality of contact elements that can be inserted into said recess from said second major surface to said first major surface.

19. A retention system for connecting a connector to a substrate having mounting pads on a surface thereof, comprising:

a retention member for retaining said connector to said substrate, said retention member comprising a first leg and a second leg integrally connected together, said second leg having a part thereof defining a solder edge;

a connector housing having an endwall with a first arm and a second arm extending from a surface of said endwall to form a channel therebetween through which said retention member is insertable; and retention structure disposed between said first and second arms, said retention structure and said arms forming access openings through which access to said retention member is provided, said retention structure securing said retention member to said connector housing.

20. The system of claim 19, wherein said solder edge is soldered to at least one of said mounting pads.

21. The system of claim 19, wherein said retention member is substantially T-shaped.

22. The system of claim 19, wherein said retention member is capable of being inserted through said channel such that said solder edge extends below a bottom surface of said connector housing and remains substantially within a footprint of said connector housing.

23. The system of claim 19, further comprising:

locking edges formed on one of said legs of said retention member and cooperating with said first and second arms to secure said retention member to said connector housing.

24. The system of claim 23, wherein said locking edges comprise at least one protrusion formed thereon.

25. A retention system for connecting a connector to a substrate having mounting pads on a surface thereof, comprising:

a retention member for retaining said connector to said substrate, said retention member comprising a first leg and a second leg integrally connected together, said second leg having a part thereof defining a solder edge;

a connector housing having an endwall with a first arm and a second arm extending from a surface of said endwall to form a channel therebetween through which said retention member is insertable; and a control surface formed within a plane intersecting the surface of said end wall at a height intermediate to the height of said end wall disposed between said first and second arms for use in controlling the position of the solder edge with respect to a bottom surface of the housing.

26. The system of claim 25, wherein said retention member is capable of being inserted through said channel such that said solder edge extends below a bottom surface of said connector housing and remains substantially within a footprint of said connector housing.

27. The system of claim 25, wherein an inlet is formed on each side of the control surface through which access to said retention member is provided.

* * * * *

UNITED STATES PATENT AND TRADEMARK OFFICE

CERTIFICATE OF CORRECTION

PATENT NO. : 5,395,265
DATED : March 7, 1995
INVENTOR(S) : Vincent D. DiMondi, John D. Walden and Gerald N. Wilson It is certified that error appears in the above-indentified patent and that said Letters Patent is hereby corrected as shown below:

On the Title page, under References Cited, the following patents and publications should appear:

References Cited

U.S. PATENT DOCUMENTS

| | | | |
|---|---|---|---|
| 3,601,770 | 8/24/71 | Bowley | 339/125R |
| 4,025,147 | 5/24/77 | Van Arsdale et al. | 339/176MP |
| 4,496,207 | 1/29/85 | Ensminger | 339/99 |
| 4,616,893 | 10/14/86 | Feldman | 339/14R |
| 4,629,278 | 12/16/86 | Norton et al. | 339/134 |
| 4,691,971 | 9/8/87 | Hahn | 439/78 |
| 4,826,442 | 5/2/89 | Douty et al. | 439/92 |
| 4,907,987 | 3/13/90 | Douty et al. | 439/571 |
| 5,004,430 | 4/2/91 | DelGuidice et al. | 439/350 |
| 5,007,844 | 4/16/91 | Mason et al. | 439/68 |
| 5,026,291 | 6/25/91 | David | 439/67 |
| 5,096,440 | 3/17/92 | Katsumata | 439/570 |
| 5,120,256 | 6/9/92 | Walden | 439/553 |
| 5,186,654 | 2/16/93 | Enomoto et al. | 439/570 |
| 5,259,789 | 11/9/93 | Patel et al. | 439/570 |

FOREIGN PATENT DOCUMENTS 0 210 686 4/2/87 European Patent Office

OTHER PUBLICATIONS

Hirose Inc., Product Literature, HRS DF9 Series, "SMT 1mm Center Line Board To Board Connector", pp. 23-29.

JAE Electronics No. 101, Product Literature, "SX Series Connector".

UNITED STATES PATENT AND TRADEMARK OFFICE

CERTIFICATE OF CORRECTION

PATENT NO. : 5,395,265
DATED : March 7, 1995
INVENTOR(S) : Vincent D. DiMondi, John D. Walden and Gerald N. Wilson It is certified that error appears in the above-indentified patent and that said Letters Patent is hereby corrected as shown below:

Column 4, Line 58 - "surfate" should be typed as "surface".

Column 4, Line 59 - ", " after "12" should be deleted.

Column 5, Line 65 - "Camming" should be typed as "camming".

Column 8, Line 37 - "." after "member" should be deleted.

Column 9, Line 33 - a space " " should be inserted between "clip" and "80'".

Signed and Sealed this

Ninth Day of May, 1995

Bruce Lehman

*Attest:*

BRUCE LEHMAN

*Attesting Officer*

*Commissioner of Patents and Trademarks*